US005703836A

United States Patent [19]

Drumheller

[11] Patent Number: 5,703,836

[45] Date of Patent: Dec. 30, 1997

[54] ACOUSTIC TRANSDUCER

[75] Inventor: Douglas S. Drumheller, Cedar Crest, N. Mex.

[73] Assignee: Sandia Corporation, Albuquerque, N. Mex.

[21] Appl. No.: 620,057

[22] Filed: Mar. 21, 1996

[51] Int. Cl.[6] ..... H04R 17/00

[52] U.S. Cl. ..... 367/165; 367/82; 367/157

[58] Field of Search ..... 367/82, 157, 159, 367/165, 166; 340/854.4

[56] References Cited

U.S. PATENT DOCUMENTS

| | | | |
|---|---|---|---|
| 3,673,442 | 6/1972 | Sonderegger | 310/329 |
| 3,968,473 | 7/1976 | Patton et al. | 367/83 |
| 4,518,888 | 5/1985 | Zabcik | 310/334 |
| 5,222,049 | 6/1993 | Drumheller | 367/82 |
| 5,357,486 | 10/1994 | Pearce | 367/159 |

*Primary Examiner*—Ian J. Lobo
*Attorney, Agent, or Firm*—Gregory A. Cone

[57] ABSTRACT

An acoustic transducer comprising a one-piece hollow mandrel into the outer surface of which is formed a recess with sides perpendicular to the central axis of the mandrel and separated by a first distance and with a bottom parallel to the central axis and within which recess are a plurality of washer-shaped discs of a piezoelectric material and at least one disc of a temperature-compensating material with the discs being captured between the sides of the recess in a pre-stressed interference fit, typically at 2000 psi of compressive stress. The transducer also includes a power supply and means to connect to a measurement device. The transducer is intended to be used for telemetry between a measurement device located downhole in an oil or gas well and the surface. The transducer is of an construction that is stronger with fewer joints that could leak fluids into the recess holding the piezoelectric elements than is found in previous acoustic transducers.

15 Claims, 3 Drawing Sheets

ACOUSTIC TRANSDUCER

This invention was made with Government support under Contract DE-AC04-94AL85000 awarded by the U.S. Department of Energy. The Government has certain rights in the invention.

BACKGROUND OF THE INVENTION

This invention relates to acoustic transducers. More particularly, the invention relates to acoustic transducers employing piezoelectric elements so packaged as to be able to withstand high temperature and corrosive environments such as downhole in gas and oil wells and to be utilized for communications purposes therewith.

Gas and oil wells are completed with a string of production tubing which includes various packers, valves, and pumps. Downhole pressure and temperature gages with hard-wire connections to the surface may also be included. These gages are expensive and unreliable because the wire must be strapped to the outside of the tubing. However, these downhole data are invaluable for timely assessment of well performance and corrective action to optimize production. These data can be crucial to both small independent and major operators alike and affect decisions ranging from the abandonment of a mature well to an expensive workover on an offshore platform.

It is desirable to provide a complete system of downhole monitoring and control equipment with can be remotely operated to optimize production and reduce the number of workover operations. It is also desired to reduce the costs of existing tools and thereby make them accessible to a wider range of operators. Because hard-wired communication is the most expensive and least reliable component of the downhole monitoring system, there is an unmet need to be able to replace the expensive hard-wire connection with an inexpensive, non-intrusive two-way telemetry system. The solution presented herein is to utilize the production tubing as a waveguide to carry pulse-modulated elastic waves. What is required to implement this solution is a new apparatus for generating/receiving the elastic waves that can function reliably in the severe downhole environment. This apparatus constitutes the invention herein and comprises a specially constructed piezoelectric transducer installed on a mandrel that can be coupled to the production tubing.

The transducer described herein follows in the footsteps of a variety of piezoelectric transducers that have been used previously in the oil industry but of different construction and for different purposes. For example piezoelectric transducers have been used for many years as seismic wave sources for marine geophysical exploration mapping studies. These types of piezoelectric acoustic generators would not work in the particular environment contemplated here; namely, high temperature downhole conditions in a production situation for long, unattended remote telemetry applications. First, they are not designed to couple mechanically or acoustically to tubing; and, second, they typically are designed to produce a higher frequency, lower power output that is unsuitable to downhole communication purposes. Several specific problems complicate the use of the piezoelectric acoustic transducer herein. First, the transducer must be able to function both at room temperature where it is built, tested and calibrated and also function with the same characteristics in the high temperature downhole environment. This requires a robust temperature compensation system. Also, the tool must allow for the passage of oil or gas through an interior passage way up to the surface because of the use of the tool in a production situation. Further, the transducer must be of a strong enough construction as to be able to withstand the stress of being inserted into and pulled out of the hole as well as the static tension placed on the production tubing string after the wellhead is completed.

SUMMARY OF THE INVENTION

The acoustic transducer of this invention comprises a hollow unitary mandrel having a cylindrical recess formed in the outer wall of the mandrel within which recess is captured a stack of piezoelectric elements in a temperature compensated interference fit. The transducer assembly also includes a power source and a protective shell that covers the region of the mandrel that captures the piezoelectric elements. The mandrel can also be adapted to connect to the production tubing that serves as the waveguide from the transducer to the surface. The transducer is further adapted to receive information from a downhole measurement device such as a pressure/temperature gage.

DETAILED DESCRIPTION OF THE INVENTION

Although the acoustic transducer of this invention is capable of a variety of different uses, it is initially intended to be integrated into a larger downhole measurement and telemetry system for use in the petroleum industry. The inventor herein has participated in the creation of several technologies useful to the practice of this invention, some of which are in the open literature and some of which are contained in U.S. Pat. 5,056,067 for an "Analog Circuit for Controlling Acoustic Transducer Arrays"; U.S. Pat. No. 5,222,049 for an "Electromechanical Transducer for Acoustic Telemetry System"; U.S. Pat. No. 5,128,901 for "Acoustic Telemetry in a Drill String Using Inverse Distortion and Echo Suppression"; U.S. Pat. No. 5,274,606 for a "Digital Circuit for Echo and Noise Suppression in a Drill String"; and most recently U.S. Pat. No. 5,477,505 for "Downhole Pipe Selection for Acoustic Telemetry." These patents are incorporated by reference herein in their entirety. These patents discuss the prior art of acoustic telemetry in detail and the present state of the art in power supplies, signal processing and tuning of the tubing string for maximum transmission efficiency. In particular, U.S. Pat. No. 5,222,049 discusses an earlier type of acoustic transducer for use in measurement while drilling. The construction of this transducer involves a plurality of joints and connections that create potential areas of weakness, acoustic impedance and fluid leakage channels that are not present in the instant invention.

Figure 1:
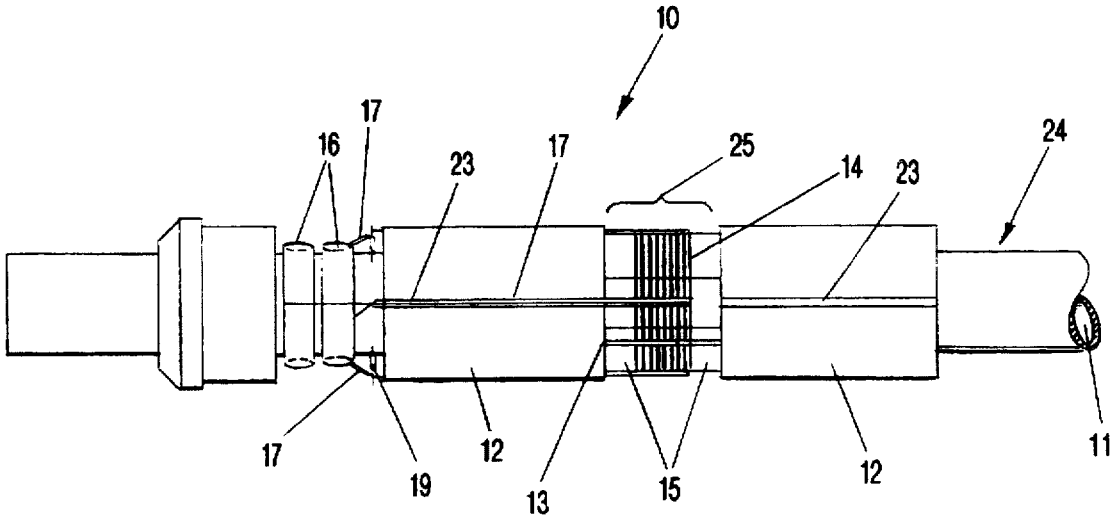
FIG. 1 is a side view of the transducer with the protective cover removed and showing the mandrel, the power supply, the piezoelectric stack and the temperature-compensating spacers.
Figure 2:
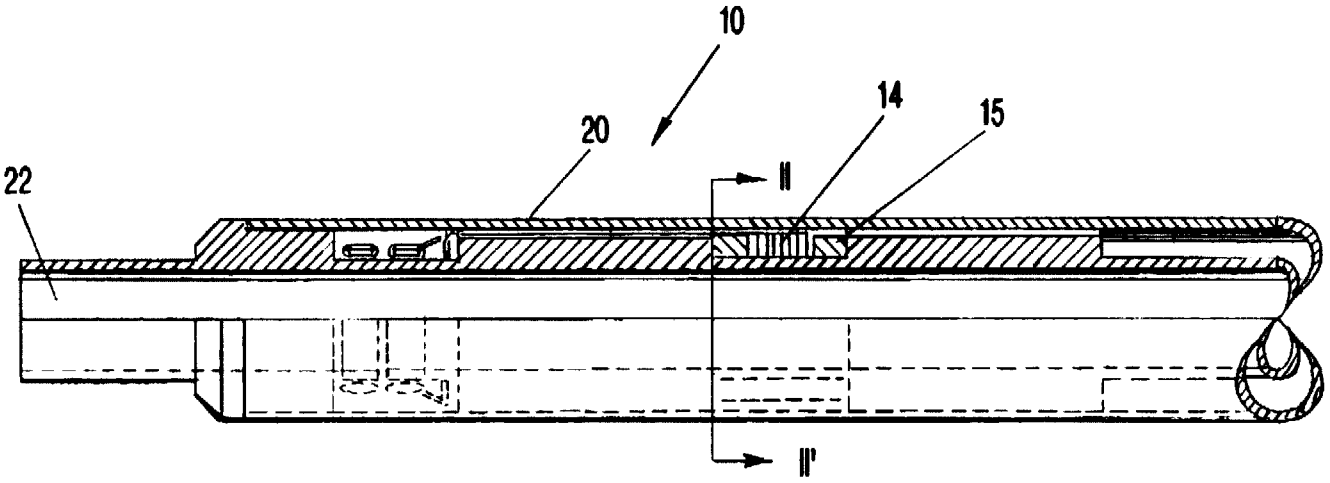
FIG. 2 is another side view of the transducer that is partially cut away and further showing a cross-section of the transducer taken near the piezoelectric stack with the protective cover in place.
Figure 2A:
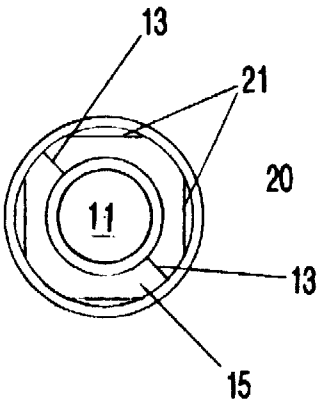

Referring now to the drawing figures, the acoustic transducer 10 is designed for the preferred embodiment to be placed into production tubing, not shown, within the oil or gas well. The transducer 10 would be provided with threaded couplings at each end, not shown, in order to be joined with the production tubing. The transducer comprises the hollow mandrel 12, the stack of piezoelectric elements 14, the temperature-compensating rings 15, the coils (or transformers) 16 of the power supply and wires 17 to connect the piezoelectric elements 14 with the rest of the power supply. The power supply itself is the combination of a tank circuit made up of the coils 16 (the inductive component) and the piezoelectric elements 14 (the capacitive component) in combination with batteries, controllers, and push-pull FET's of conventional design (not shown) located in the region 24 at the right end of the mandrel. Not shown are means to conduct information from or to a tool or sensor to the power supply. The sensor could also be located in the region 24. This region 24 extends for some distance beyond that shown in the Figures, and as constructed the total length of the transducer 10 was about 6 feet. FIG. 1 shows the transducer 10 with the piezoelectric stack 14 and the coils 16 and wire 17 exposed. In normal operation, a protective cover 20 as shown in FIG. 2 would be emplaced about the outside of the transducer as shown. The protective cover 20 acts to shield the transducer components from mechanical injury and also to seal out the various fluids from these components. Notice however that the interior 11 of the mandrel 12 is hollow to as to allow the production fluids to be conveyed from below the transducer in the well to the surface. Here this interior diameter is approximately 2 inches, and the outside diameter of the protective cover 20 is about 3⁴ ½ inches. These dimensions will depend on the size of the tubulars used in a particular well but conform here generally to standard practice in the industry.

The method of construction of the transducer is of primary interest. The traditional method would be to create a stack of piezoelectric disc, most commonly made of PZT ceramics, form a hole in the middle and compress the stack between the head of a hollow bolt that passes through the hole in the stack and a nut, since the piezoelectric elements function well as transducers only when they are pre-stressed so as to always be in compression. However, this technique would not work well here for several reasons. The high longitudinal stresses placed on the production string during placement and removal would dictate something stronger than the hollow bolt concept. Also, the piezoelectric elements themselves are rather fragile and are coated with a fragile electrode coating as well. Both of these characteristics militate against a system that requires rotation of elements to tighten up the stack to achieve the compressive pre-stress condition. The solution herein is to use a solid mandrel 12 with a machined cylindrical recess 25 formed therein to hold the piezoelectric stack. It is also important to minimize the avenues by which production fluids, which include oil, high pressure gas, and salt water, can enter into the area of the piezoelectric stack and the power supply. The present use of a solid mandrel eliminates the threaded connection between the hollow bolt and the nut as such an avenue for fluid invasion. Once it was determined herein the use a solid mandrel, the problem then became how to securely fit and retain the piezoelectric stack within the recess. The solution is to form the stack of the various piezoelectric elements (here glued together) configured here as washer-shaped elements with an inside diameter matched to the outside diameter of the mandrel at the bottom of the recess 25 with the washer-shaped elements having an outer diameter slightly less than the outside diameter of the mandrel adjacent the recess 25. The stack of piezoelectric elements is then cut in half diametrically. In the alternative, the stack can be formed initially as halves rather than being cut in half. Similarly, temperature-compensating washers 15, made here of brass, of similar diameter to the piezoelectric stack are cut in half (or formed initially as halves). Then the mandrel is heated to a sufficient temperature so as to cause the width of the recess to expand slightly. At this point the halves of the brass washers 15 and the halves of the piezoelectric stack 14 are reassembled in the expanded recess. When the mandrel cools and contracts, the washers and the piezoelectric stack are captured securely in an interference fit in the mandrel recess. It is generally desirable to create a compressive load on the ceramic which is equal to about 2000 psi. This roughly corresponds to an interference fit of 0.0002 inches per inch of recess width. The tolerance on the slot width should be about half of this value. Thus, if the longitudinal dimension of the piezoelectric stack is one inch, the tolerance of the slot would be 0.0001 inches. It is recognized that this presents a very tight tolerance; however, the resulting simplification of the rest of the mechanical ensemble outweighs the difficulties associated with this procedure.

It is important that the transducer have relatively constant response to a given input signal regardless of the temperature downhole. However, the mandrel will normally be made of steel, which has a different thermal expansion coefficient than do the PZT ceramic discs. Unless the mandrel is made of invar alloy which has the same coefficient as the PZT ceramic, a proper interference fit of about 2000 psi at room temperature will reduce to zero when a steel mandrel is heated about 100 degrees F., and the halves of the discs will no longer be restrained therein by the pressure at this higher temperature. The solution here is to include washers of a temperature compensating material, i.e. brass, of a suitable thickness such that the interference fit pre-stress of the side wall of the recess on the combination of the temperature-compensating washers and the piezoelectric stack will be relatively constant with changes in temperature. It would be possible to use only one brass washer at one end of the recess; however, it is preferred to use two brass washers, one at each end. The term 'piezoelectric stack' used herein means a stack of discs of a single chemical composition or a combination of discs of different chemical compositions either of which exhibit the piezoelectric effect. Similarly, 'piezoelectric material' is intended to mean a material that exhibits the piezoelectric effect, where the material itself is not necessarily all of a single chemical composition.

Returning to the drawings, the section view II–II' in FIG. 2 shows the face of one of the brass temperature-compensating washers 15 and also the interface 13 between the two halves of the washer when they are recombined about the mandrel. Also shown in this sectional view are four flattened areas 21 on the outside edge of the brass washers (and also on the piezoelectric stack) which create an interior space underneath the protective cover 20 through which run the wires 17 shown in FIG. 1. These wires are supported by stand-off posts 19 immediately after they leave the power supply 16 but before they enter the protective grooves 23 in the outside surface of the mandrel. Other wires, not shown, run between the region 24 with the rest of the power supply components and the sensor (both not shown) to the piezoelectric elements 14.

The piezoelectric stack was made by EDO-Western, the mandrel was machined and the stack mounted by Baker Industries, and transducer assembly was tested at Sandia National Laboratories in Albuquerque, N. Mex. The dimensions of the various components can vary. Here the inside diameter 11 of the mandrel is about 2 inches, the outside diameter of the protective cover 20 is about 4.5 inches, and the overall length of the transducer 10 is about 6 feet. The piezoelectric stack 14 itself was made of 60 individual elements, each 0.030 inches thick and coated with an electrode material (here Ag). The total thickness of the stack 14 was about 2½ inches. The combined thickness of the two brass temperature-compensating washers was also about 2½ inches. The stack was of standard construction except for the method of installation discussed above, here being formed initially in two halves. The ceramics used here were of the type generally known as PZT-8. They are available form Channel Industries, Santa Barbara, Calif. as product "5800", and from EDO-Western Corporation in Salt Lake City, Utah as product "EC 69".

Figure 3:
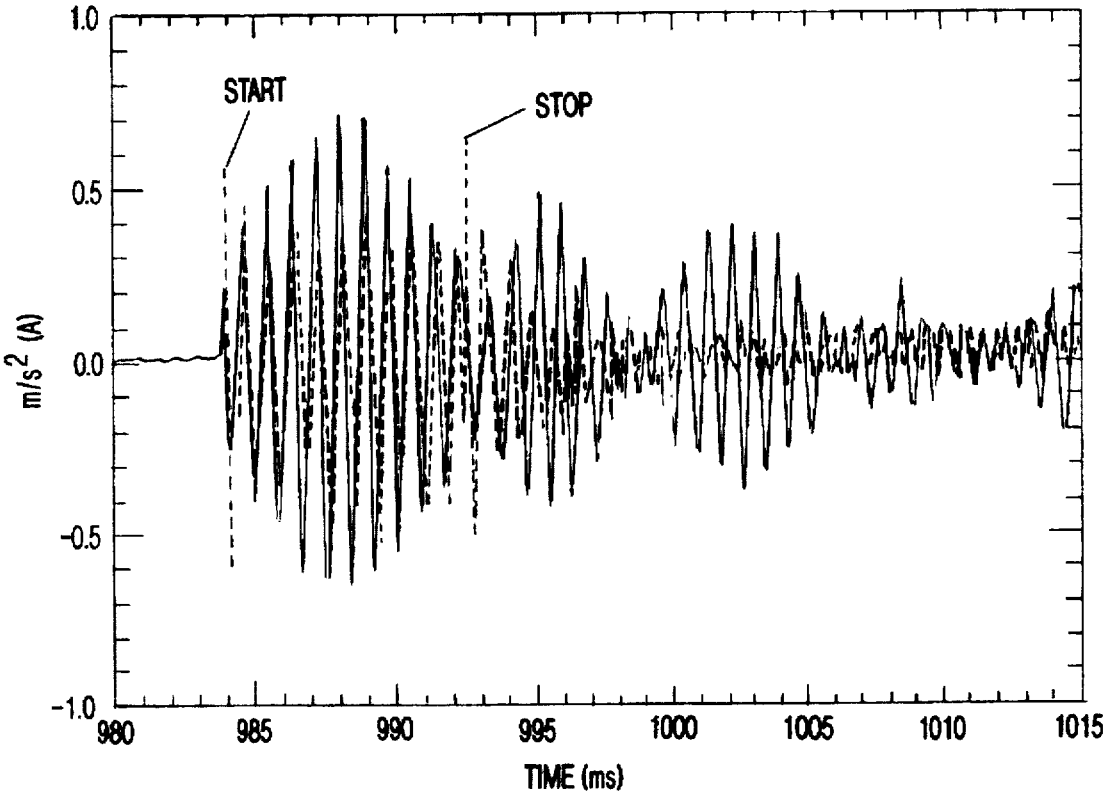
FIG. 3 is a graph showing the measured and theoretical output of the transducer.

The testing of the transducer was done at a laboratory that has a 1500-foot tubing string. For the test, an accelerometer was mounted 45 feet up the tubing from the transducer. A voltage input of 10 sine waves was used. The measured amplitude at the accelerometer exceeded the theoretical prediction. The transducer used here is capable of delivering 10 W of acoustic energy into the tubing string. Estimated system efficiency of energy conversion is approximately 40%. FIG. 3 shows the actual (solid line) and theoretical (dotted line) response of the 1500-foot tubing string to a ten cycle sine wave input at 1200 Hz. The start and stop points for the ten cycle input are shown.

I claim:

1. An active acoustic transducer comprising a one-piece hollow mandrel in the form of a modified cylinder that is symmetric about a central axis into the outer surface of which mandrel is formed a recess with sides perpendicular to the central axis, said sides being separated by a first distance, and with a bottom parallel to the central axis and at a constant radial distance therefrom and within which recess are a plurality of segmented washer-shaped discs of a piezoelectric material, the washer-shaped discs having an inner radius slightly larger than the constant radial distance of the bottom of the recess and an outer radius slightly less than the top of the sides of the recess with the plurality of discs being captured between the sides of the recess in a pre-stressed interference fit.

2. The transducer of claim 1 additionally including a power supply means electrically connected to the plurality of discs of the piezoelectric material.

3. The transducer of claim 1 additionally including at least one washer-shaped disc of a temperature-compensating material of the same approximate radial dimensions as the discs of the piezoelectric material located within the recess and captured therewithin with the plurality of discs of the piezoelectric material in the pre-stressed interference fit.

4. The transducer of claim 3 wherein the at least one disc of the temperature-compensating material has a thermal coefficient of expansion and a width, in total, such that the compressive stress from the pre-stressed interference fit on the plurality of discs of the piezoelectric material will remain within predetermined limits sufficient to allow the effective operation of the transducer.

5. The transducer of claim 3 wherein the at least one disc of the temperature-compensating material is realized as two such discs, one located against one side wall and the other located against the other side wall.

6. The transducer of claim 1 further including a protective cover plate disposed over the recess.

7. The transducer of claim 6 wherein the protective cover plate extends past the side walls and is adapted to exclude fluids from entering into the recess.

8. The transducer of claim 2 wherein the power supply means is located in a second recess in the mandrel.

9. The transducer of claim 1 wherein the radius of the hollow interior region of the mandrel is sufficient to allow for the passage of hydrocarbon fluids in production quantifies.

10. The transducer of claim 1 wherein the ends of the mandrel are adapted to connect to threaded tubing.

11. The transducer of claim 2 further including means to communicate with a measurement device located proximate to the transducer.

12. An active acoustic transducer comprising a one-piece hollow mandrel in the form of a modified cylinder that is symmetric about a central axis into the outer surface of which mandrel is formed a recess with sides perpendicular to the central axis, said sides being separated by a first distance, and with a bottom parallel to the central axis and at a constant radial distance therefrom and within which recess are a plurality of segmented washer-shaped discs of a piezoelectric material and at least one disc of a temperature-compensating material, the discs having an inner radius slightly larger than the constant radial distance of the bottom of the recess and an outer radius slightly less than the top of the sides of the recess with the discs being captured between the sides of the recess in a pre-stressed interference fit, the transducer further including a power supply electrically connected to the plurality of discs of the piezoelectric material.

13. The transducer of claim 12 wherein the at least one disc of the temperature-compensating material has a thermal coefficient of expansion and a width, in total, such that the compressive stress from the interference fit on the plurality of discs of the piezoelectric material will remain within predetermined limits sufficient to allow the effective operation of the transducer.

14. The transducer of claim 12 wherein the at least one disc of the temperature-compensating material is realized as two such discs, one located against one side wall and the other located against the other side wall.

15. The transducer of claim 12 further including means to communicate with a measurement device located proximate to the transducer.

* * * * *